US012540376B2

(12) United States Patent
Ogasawara et al.

(10) Patent No.: US 12,540,376 B2
(45) Date of Patent: Feb. 3, 2026

(54) NICKEL-BASED ALLOY HAVING SUPERIOR SURFACE PROPERTIES AND PRODUCTION METHOD FOR THE SAME

(71) Applicant: Nippon Yakin Kogyo Co., Ltd., Tokyo (JP)

(72) Inventors: Daiki Ogasawara, Kawasaki (JP); Fumiaki Kirihara, Kawasaki (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 390 days.

(21) Appl. No.: 18/039,659

(22) PCT Filed: Mar. 7, 2022

(86) PCT No.: PCT/JP2022/009727

§ 371 (c)(1),
(2) Date: May 31, 2023

(87) PCT Pub. No.: WO2023/062856

PCT Pub. Date: Apr. 20, 2023

(65) Prior Publication Data

US 2025/0263815 A1 Aug. 21, 2025

(30) Foreign Application Priority Data

Oct. 11, 2021 (JP) ..... 2021-166930

(51) Int. Cl.

| | |
|---|---|
| ***C22C 19/05*** | (2006.01) |
| ***B22D 11/00*** | (2006.01) |
| ***C22B 9/05*** | (2006.01) |
| ***C22B 9/10*** | (2006.01) |
| ***C22C 1/02*** | (2006.01) |
| ***C22F 1/10*** | (2006.01) |

(52) U.S. Cl.

CPC ..... *C22C 19/055* (2013.01); *B22D 11/001* (2013.01); *C22B 9/05* (2013.01); *C22B 9/10* (2013.01); *C22C 1/023* (2013.01); *C22F 1/10* (2013.01)

(58) Field of Classification Search

CPC ..... C22C 19/056; C22C 19/055; C22F 1/10

See application file for complete search history.

(56) References Cited

U.S. PATENT DOCUMENTS 5,529,642 A 6/1996 Sugahara et al.

FOREIGN PATENT DOCUMENTS

| | | | |
|---|---|---|---|
| EP | 648850 | A1 | 4/1995 |
| JP | S62-158844 | A | 7/1987 |
| JP | S62-158847 | A | 7/1987 |
| JP | H07-252564 | A | 10/1995 |
| JP | H08-003666 | A | 1/1996 |
| JP | H08-003670 | A | 1/1996 |
| JP | H11-315354 | A | 11/1999 |
| JP | 2019-039021 | A | 3/2019 |
| JP | 2020-094251 | A | 6/2020 |
| JP | 2021-070838 | A | 5/2021 |

OTHER PUBLICATIONS

English Abstract and English Machine Translation of Kobayashi et al. (JP 2019-039021) (Mar. 14, 2019).*

Apr. 12, 2022 International Search Report issued in International Patent Application No. PCT/JP2022/009727.

* cited by examiner

*Primary Examiner* — Jessee R Roe

(74) *Attorney, Agent, or Firm* — Oliff PLC

(57) ABSTRACT

A composition of non-metallic inclusions that affect surface properties and provides Ni-based alloys with superior surface properties. A Ni-based alloy consisting of: all by mass %, Ni: 52.0% or more, C: 0.001% to 0.030%, Si: 0.01 to 0.10%, Mn: 0.10 to 1.50%, P: 0.030% or less, S: 0.0050% or less, Cr: 13.0 to 25.0%, Mo: 10.0 to 18.0%, W: 1.00 to 5.00%, Cu: 1.00% or less, Co: 3.00% or less, Al: 0.001 to 0.170%, Fe: 2.00 to 8.00%, Mg: 0.0010 to 0.0200%, Ca: 0.0001 to 0.0040%, V: 0.500% or less, Nb: 0.001 to 0.100%, O: 0.0001 to 0.0050%, wherein the non-metallic inclusions includes one or more of MgO, CaO, CaO—MgO-based oxides, CaO—$Al_2O_3$—MgO-based oxides, and MgO.$Al_2O_3$, the MgO.$Al_2O_3$ has number ratio of 50% or less with all oxide-based non-metallic inclusions.

12 Claims, No Drawings

NICKEL-BASED ALLOY HAVING SUPERIOR SURFACE PROPERTIES AND PRODUCTION METHOD FOR THE SAME

TECHNICAL FIELD

The present invention relates to nickel alloys having superior surface properties and to smelting methods for the same, and specifically relates to nickel alloys having superior surface properties and to production methods for the same, by controlling the slag composition and Si, Al, Mg, Ca, and O in the molten metal, thereby controlling non-metallic inclusions in the molten metal to be harmless compositions, and further reducing the number of inclusions on the surface, and more specifically relates to, in particular, Ni-based alloys for which pitting corrosion resistance and acid resistance are strongly demanded, such as for flue gas desulfurization apparatuses.

BACKGROUND ART

Since flue gas desulfurization apparatuses used in ships and thermal power plants are used in severe sulfuric acid environments, Ni-based alloys that contain large amounts of Ni, Cr, Mo, W, and the like, and have improved corrosion resistance and acid resistance are widely used. In recent years, the demand for Ni-based alloys has been increasing as environmental regulations for ship exhaust gas have become more stringent.

Ni-based alloys, which are superior in corrosion resistance and acid resistance, contain Cr, Mo, and W along with Ni, which is the main component, and these metals are extremely expensive compared to iron. Therefore, it is very important to improve yield and keep production costs down. Here, if surface defects such as linear flaws occur on the surface of the Ni-based alloy, the yield is greatly reduced. Therefore, Ni-based alloys having superior surface properties are required.

Under such circumstances, Patent Document 1 discloses a technique, in which, in a method for producing a high-Ni alloy for high temperatures and a high-Ni alloy containing Al and Ti, by setting the Ca/Al mass ratio in oxide-based inclusions within 1.0 to 1.5, the composition of the oxide-based inclusions is controlled to a $CaO—Al_2O_3$-based with a low melting point to prevent clogging of the immersion nozzle of a continuous casting machine, thereby preventing surface flaws in the product.

However, the Ni alloy of Patent Document 1 is intended for a Ni content of 18 to 50 mass %, which is different from the Ni-based alloy containing more than 50 mass % of Ni of the present invention. The Ni content greatly affects control of inclusion composition, and even if trace quantities such as Ca, Mg, Al, Si, and O are the same, the composition of oxide-based non-metallic inclusions differs greatly. That is, the method of controlling the composition of non-metallic inclusions described in Patent Document 1 cannot sufficiently improve the surface defects of Ni-based alloys containing more than 50 mass % of Ni.

Patent Document 2 discloses a technique, in which in a high Ni alloy, the composition of non-metallic inclusions in the alloy is controlled, and low-melting inclusions with good elongation and splitting properties during hot or cold rolling are formed to reduce surface flaws.

However, the high Ni alloy of Patent Document 2 is intended for those containing 30 to 50 mass % of Ni, and it is different from the Ni-based alloy containing more than 50 mass % of Ni of the present invention. The Ni content greatly affects control of the inclusion composition, and even if trace quantities such as Ca, Mg, Al, Si, and O are the same, the composition of oxide-based non-metallic inclusions differs greatly. That is, the method of controlling the composition of non-metallic inclusions described in Patent Document 2 cannot be applied to improve surface defects in Ni-based alloys containing more than 50 mass % of Ni.

Patent Document 3 discloses a Ni-based alloy material containing 40 to 70 mass % of Ni and having superior corrosion resistance and strength, in which the length of Ti-based inclusions mainly composed of TiN and Ti (C, N) in the microstructure is 10 μm or less.

However, a necessary method for controlling oxide-based non-metallic inclusions for improving the surface properties of Ni alloys is not disclosed. That is, the problem of surface defects in oxide-based non-metallic inclusions in Ni-based alloys containing more than 50 mass % of Ni remains unsolved.

Patent Document 4 discloses a Ni—Cr—Mo—Nb alloy having a Ni content of about 58 mass % or more characterized by containing MgO alone and a composite oxynitride of MgO and (Ti, Nb) N as non-metallic inclusions, and discloses a producing method that suppresses the formation of large clusters of non-metallic inclusions by optimizing the alloy components, and obtains good quality without surface defects in thin plate products.

However, Patent Document 4 is a patent for an alloy containing 2.5 to 5 mass % of Nb, and since Nb is an element that is easily oxidized to the same degree as Si and Mn, the target Nb content cannot be obtained unless Nb is added after sufficiently deoxidizing with Al in the refining process. That is, Patent Document 4 discloses a control method of the inclusion composition of a Ni—Cr—Mo—Nb alloy containing 2.5 to 5 mass % of Nb, which has a deoxidizing capacity similar to that of Si and Mn, which greatly affects the inclusion composition. In the control of inclusion composition of Ni-based alloy containing more than 50 mass % of Ni and Nb: 0.001 to 0.100 mass %, which is the target of the present invention, since the composition range of Nb that greatly affects the composition of inclusions is different from the present invention, the contents disclosed in Patent Document 4 cannot be used as they are, and further improvements are required.

The Patent documents are as follows.

Patent document 1: Japanese Unexamined Patent Application Publication No. 2021-70838

Patent document 2: Japanese Unexamined Patent Application Publication No. H11-315354

Patent document 3: Japanese Unexamined Patent Application Publication No. H07-252564

Patent document 4: Japanese Unexamined Patent Application Publication No. 2019-39021

SUMMARY OF INVENTION

Problems Solved by the Invention

In view of the above problems, an object of the present invention is to control the composition of non-metallic inclusions that affect the surface properties and to produce Ni-based alloys having superior surface properties. Furthermore, the present invention provides a production method for realizing this.

Means for Solving the Problem

In order to solve the above problems, the inventors have conducted extensive research and investigations, and have analyzed surface defects in Ni-based alloy cold-rolled plates with a scanning electron microscope (SEM) and an energy dispersive X-ray spectrometer (EDS), and as a result, it was found that the cause of surface defects is non-metallic inclusions of $MgO \cdot Al_2O_3$-based, CaO, and CaO—MgO-based oxides. This type of non-metallic inclusion tends to adhere to the inner wall of the immersion nozzle for pouring molten metal from the tundish into the mold in a continuous casting machine and tends to grow in size. The inclusions that have fallen off are trapped by the solidified shell and become the starting point of surface defects. Furthermore, since the inclusions have high melting points, they are difficult to stretch during hot rolling, and they are not dispersed into small particles. As a result, the inclusions are the starting points of surface defects of the Ni-based alloy cold-rolled plate.

The inventors further conducted extensive research on the relationship between the composition of inclusions and the metal components in Ni-based alloys. Specifically, in the production process of the Ni-based alloy, a metal sample of the Ni-based alloy was taken from the tundish, 20 inclusions exceeding 5 μm in the sample were randomly selected, and the inclusion composition was measured by SEM/EDS. Also, an immersion nozzle for supplying molten metal from the tundish in the continuous casting machine to the mold was sampled, and the components of deposits on the inner wall of the nozzle were analyzed by SEM/EDS. Based on the above, the inventors conducted extensive research on the relationship between the composition of inclusions, metal components, and deposits on the inner wall of immersion nozzles.

As a result, it was found that the non-metallic inclusions of the Ni alloy contain one or more of MgO, CaO, CaO—MgO-based oxides, CaO—$Al_2O_3$—MgO-based oxides, and $MgO \cdot Al_2O_3$, and furthermore, by controlling the Si concentration within 0.01 to 0.10 mass % and controlling the Al concentration within 0.001 to 0.170 mass %, and adjusting the Mg concentration within 0.0010 to 0.0200 mass % and adjusting the Ca concentration within 0.0001 to 0.0040 mass %. % and O concentration within O: 0.0001 to 0.0050 mass %, it is possible to basically control the inclusion composition to MgO or CaO—$Al_2O_3$—MgO-based oxides. Furthermore, it was found that when the number ratio of $MgO \cdot Al_2O_3$ is 50% or less with respect to all oxide-based non-metallic inclusions, and the total number ratio of CaO and CaO—MgO-based oxides is 50% or less, the non-metallic inclusions are less likely to deposit on the inner wall of the immersion nozzle, that is, less likely to increase in size and less likely to cause surface defects. It was also found that such non-metallic inclusions are finely divided during hot rolling and cold rolling, and thus, are superior in cleanness.

The present invention has been made based on the above knowledge, and provides a Ni-based alloy consisting of: all by mass %, Ni: 52.0% or more, C: 0.001% to 0.030%, Si: 0.01 to 0.10%, Mn: 0.10 to 1.50%, P: 0.030% or less, S: 0.0050% or less, Cr: 13.0 to 25.0%, Mo: 10.0 to 18.0%, W: 1.00 to 5.00%, Cu: 1.00% or less, Co: 3.00% or less, Al: 0.001 to 0.170%, Fe: 2.00 to 8.00%, Mg: 0.0010 to 0.0200%, Ca: 0.0001 to 0.0040%, V: 0.500% or less, Nb: 0.001 to 0.100%, O: 0.0001 to 0.0050%, and the balance of inevitable impurities; the alloy comprising non-metallic inclusions, in which the non-metallic inclusions comprise one or more of MgO, CaO, CaO—MgO-based oxides, CaO—$Al_2O_3$—MgO-based oxides, and $MgO \cdot Al_2O_3$, the $MgO \cdot Al_2O_3$ has a number ratio of 50% or less with respect to all oxide-based non-metallic inclusions.

In the present invention, the alloy preferably further comprises 0.070% or less of Ti and 0.070% or less of N as needed.

In the present invention, in the non-metallic inclusions, the number ratio of the total number of the CaO and the CaO—MgO-based oxides is preferably 50% or less.

In the present invention, in the non-metallic inclusions, all by mass %, CaO—MgO-based oxides preferably consists of CaO: 20 to 80% and MgO: 20 to 80%, CaO—$Al_2O_3$—MgO-based oxides preferably consists of CaO: 10 to 60%, $Al_2O_3$:5 to 60%, MgO: 10 to 80%, and $MgO \cdot Al_2O_3$ preferably consists of MgO: 10 to 40% and $Al_2O_3$:60 to 90%.

The present invention provides a production method. That is, the method comprising melting a raw material in an electric furnace, then decarburizing in AOD and/or VOD, charging lime and fluorite, then charging one or more of ferrosilicon alloy, pure silicon and Al, Cr reducing, deoxidizing and desulfurizing using CaO—$SiO_2$—MgO—$Al_2O_3$—F-based slag consisting of CaO: 50 to 75%, $SiO_2$:1 to 10%, $Al_2O_3$:5 to 25 mass %, MgO: 3 to 15%, F: 1 to 15%, producing a slab or ingot by a continuous casting machine or ordinary ingot casting, hot forging the ingot, hot rolling and cold rolling, and thereby obtaining a Ni-based alloy or Ni-based alloy plate.

MODE FOR CARRYING OUT THE INVENTION

First, reasons for limiting the chemical components of the Ni-based alloy of the present invention will be described. In the following description, "%" means "mass % (weight %)".

(C: 0.001 to 0.030%)

Although C is an austenite phase stabilizing element, when present in a large amount, it combines with Cr and Mo to form carbides, lowering the amount of solid solution Cr and Mo contained in the base metal, and deteriorating corrosion resistance. Therefore, the C content is set at the range from 0.001 to 0.030%. Preferably, it is 0.002 to 0.015%. More preferably, it is 0.003 to 0.010%.

(Si: 0.01 to 0.10%)

Si is an important element in the present invention because it is an element effective for deoxidation, and an amount of 0.01% is necessary to control the oxygen concentration to 0.0001 to 0.0050%. Furthermore, Si has a function in which CaO and MgO in the CaO—$SiO_2$—MgO—$Al_2O_3$—F-based slag are reduced, and Mg in the molten metal is adjusted to 0.0010 to 0.0200% and Ca to 0.0001 to 0.0040%, respectively. This has the effect of maintaining inclusions in harmless MgO and CaO—$Al_2O_3$—MgO-based. From this point of view, 0.01% is necessary. On the other hand, when the content exceeds 0.10%, CaO and MgO in the slag are excessively reduced, and Mg exceeds 0.0200% and Ca also exceeds 0.0040%. As a result, CaO and CaO—MgO-based oxides are formed in a total number ratio of more than 50%, and many surface defects and pits are generated on the product, resulting in deterioration of the surface properties. Furthermore, if the alloy contains an excessive amount of Mg, the hot workability is lowered, and cracks may occur during hot rolling, thereby resulting in surface defects. Therefore, the Si content is set in the range from 0.01 to 0.10%, Preferably, it is 0.02 to 0.09%, and more preferably, it is 0.03 to 0.08%.

(Mn: 0.10 to 1.50%)

Since Mn is an austenite phase stabilizing element and contributes to deoxidation, it must be added in an amount of 0.10% or more. However, since addition of a large amount deteriorates oxidation resistance, 1.50% is set for the upper limit. Preferably, it is 0.20 to 1.00%, and more preferably, it is 0.30 to 0.60%.

(P: 0.030% or Less)

P is a harmful element that segregates at grain boundaries and causes cracks during hot working. Therefore, the P content should be as low as possible and is limited to 0.030% or less. Preferably, it is 0.020% or less, and more preferably, it is 0.015% or less.

(S: 0.0050% or Less)

S is a harmful element that segregates at grain boundaries to form compounds with a low melting point and deteriorates hot workability, and the S content should be as low as possible and is limited to 0.0050% or less. To achieve this, deoxidation is promoted by setting the lower limit of the Al content to 0.001% and desulfurization is promoted by controlling the O concentration in the range from 0.0001 to 0.0050%. Preferably, it is 0.0030% or less, and more preferably, it is 0.0010% or less.

(Ni: 52.0% or More)

Ni is the main element in the Ni-based alloy of the present invention, has an austenitic structure, and is an element with high pitting corrosion resistance, crevice corrosion resistance, and stress corrosion cracking resistance in a chloride-containing solution environment. By containing 52.0% or more, it is possible to obtain pitting corrosion resistance and acid resistance that can withstand use in severely corrosive environments. Preferably, it is 54.0% or more, and more preferably, it is 55.0% or more.

(Cr: 13.0 to 25.0%)

Cr is an element that forms a passive film on the surface of the Ni-based alloy, and it is the most important element as a constituent of the base material for improving acid resistance, pitting corrosion resistance, crevice corrosion resistance, and stress corrosion cracking resistance. If the Cr content is less than 13.0%, sufficient corrosion resistance cannot be obtained. Conversely, when the content exceeds 25.0%, a o phase is formed and embrittlement is caused. For the above reasons, the Cr content is set in the range from 13.0 to 25.0%. Preferably, it is 14.0 to 23.5%, and more preferably, it is 15.0 to 22.0%.

(Mo: 10.0 to 18.0%)

Mo greatly improves the corrosion resistance in a moist environment in which chlorides are present and in a high-temperature atmosphere environment even when added in a small amount, and it has the effect of improving the corrosion resistance in proportion to the added amount. Furthermore, although the upper limit of Si effective for deoxidation is 0.10%, Mo has the effect of increasing the activity coefficient of Si and supplementing the deoxidizing capacity, and it is a useful element. Therefore, it is necessary to add 10.0% or more. On the other hand, in a material to which a large amount of Mo is added, in a high-temperature atmosphere environment and when the oxygen potential on the surface is low, Mo causes preferential oxidation, thereby causing peeling of the oxide film and causing surface defects. Therefore, the upper limit is set to be 18.0%. Preferably, it is 12.0 to 17.0%, and more preferably, it is 13.0 to 16.5%.

(W: 1.00 to 5.00%)

Since W is an element that increases the strength of the Ni-based alloy, it is added in an amount of 1.00% or more. However, since adding a large amount increases the production cost, the upper limit is set to 5.00%. Preferably, it is 2.00 to 4.50%, and more preferably, it is 2.50 to 3.50%.

(Cu: 1.00% or Less)

Cu is effective in improving sulfuric acid corrosion resistance. However, if excessively added, hot workability is reduced and surface defects due to cracking occur. Therefore, the Cu content is set to 1.00% or less. Preferably, it is 0.50% or less, and more preferably, it is 0.20% or less.

(Co: 3.00% or Less)

Co is one of the austenite stabilizing elements, but if it is added in a large amount, the raw material cost it is increased. Therefore, it is limited to be 3.00% or less. Preferably, it is 1.50% or less, and more preferably, it is 0.50% or less.

(Al: 0.001 to 0.170%)

Al is a very effective element for deoxidizing and is a particularly important element in the present invention. Al can control the oxygen concentration in the range from 0.0001 to 0.0050%, and reduces MgO and CaO in the $CaO—SiO_2—MgO—Al_2O_3—F$-based slag, and supplies 0.0010% or more of Mg and 0.0001% or more of Ca to the molten metal, respectively, and have the effect of controlling inclusions to be harmless MgO and $CaO—Al_2O_3—MgO$-base. These are due to the following reactions.

$$3(MgO)+2Al=3Mg+(Al_2O_3) \quad (1)$$

$$3(CaO)+2Al=3Ca+(Al_2O_3) \quad (2)$$

The components in the slag are shown in parentheses, and the components in the molten metal are underlined.

If the Al concentration is less than 0.001%, deoxidation will not proceed, and the oxygen concentration will exceed 0.0050%. Furthermore, since deoxidation does not proceed, desulfurization is inhibited, and the S concentration becomes high, exceeding 0.0050%. On the other hand, when the Al concentration is high and exceeds 0.170%, the Mg concentration becomes high, exceeding 0.0200% due to the reaction of the above Formula (1), and the Ca concentration also becomes high, exceeding 0.0040% due to the reaction of the above Formula (2). Therefore, the range of Al content is set in the range from 0.001 to 0.170%. Preferably, it is 0.005 to 0.100%, and more preferably, it is 0.010 to 0.080%.

(Ti: 0.070% or Less)

Ti is an element that contributes to deoxidation, but it easily reacts with N in the molten metal to form TiN. TiN adheres to the inner wall of the immersion nozzle in the continuous casting machine and accumulates, and the deposited deposits fall off and are carried into the mold with the molten metal and are captured by the solidified shell, thereby resulting in surface defects. Therefore, the Ti content is set to be 0.070% or less. Preferably, it is 0.040% or less, and more preferably, it is 0.010% or less.

(Fe: 2.00 to 8.00%)

Fe is an element that affects hot workability and cold workability, and if it is less than 2.00%, the hot workability and cold workability are deteriorated. Moreover, if it is added at more than 8.00%, crevice corrosion resistance and stress corrosion cracking resistance are reduced. Therefore, the Fe content is set in the range from 2.00 to 8.00%. Preferably, it is 4.50 to 7.50%, and more preferably, it is 5.50 to 7.00%.

(Mg: 0.0010 to 0.0200%)

Mg is an effective element for controlling the composition of oxide-based non-metallic inclusions in the molten metal to MgO, $CaO—Al_2O_3—MgO$-based oxides that do not adversely affect surface properties. The effect cannot be obtained when the content is less than 0.0010%, and conversely, when the content is more than 0.0200%, cracks are likely to occur in the hot rolling process due to the decrease in hot workability, thereby leading to surface defects in the final product. Therefore, the Mg content is set in the range from 0.0010 to 0.0200%. Preferably, it is 0.0015 to 0.0170%, and more preferably, it is 0.0020 to 0.0150%.

In order to effectively add Mg to the molten metal, it is preferable to use the reaction represented by Formula (1). In order to control Mg in the above range, the slag composition may be controlled to CaO: 50 to 75%, $SiO_2$:1 to 10%, $Al_2O_3$:5 to 25%, MgO: 3 to 15%, and F: 1 to 15%.

(Ca: 0.0001 to 0.0040%)

Ca is an effective element for controlling the composition of oxide-based non-metallic inclusions in the molten metal to CaO—$Al_2O_3$—MgO-based oxides that do not form clusters and have no adverse effect on surface quality. This effect cannot be obtained when the content is less than 0.0001%, and conversely, when the content is greater than 0.0040%, inclusions of CaO alone and/or CaO—MgO-based oxides are formed, and surface defects and pits occur on the final product. Therefore, the Ca content is set in the range from 0.0001 to 0.0040%. Preferably, it is 0.0002 to 0.0030%, and more preferably, it is 0.0003 to 0.0020%.

In order to effectively supply Ca into the molten metal, it is preferable to use the reaction represented by Formula (2). To control Ca within the above range, the slag composition may be controlled to CaO: 50 to 75%, $SiO_2$:1 to 10%, $Al_2O_3$:5 to 25%, MgO: 3 to 15%, and F: 1 to 15%.

(V: 0.500% or Less)

V is an element that improves toughness, but if a large amount of V is added, the workability is deteriorated. Therefore, the V content is set to be 0.500% or less. Preferably, it is 0.100% or less, and more preferably, it is 0.050% or less.

(Nb: 0.001 to 0.100%)

Nb is an element that easily bonds with O, C, N, and B, and forms $NbO_2$ oxide, NbC carbide, NbN nitride, and $NbB_2$ boride. When the Nb content is 0.001% or more, heat treatment of the alloy plate causes Nb to fix C as a carbide and generate NbC, thereby preventing intergranular sensitization and improving intergranular corrosion resistance. However, when the Nb content is greater than 0.100%, $NbO_2$ and NbN are formed in the molten metal, and clusters of complex oxynitrides are likely to be formed together with MgO. The clusters adhere to the inside of the immersion nozzle during continuous casting, and the $NbO_2$ and NhN also act as solidification nuclei, so that solidification of the molten metal progresses on the inner wall of the nozzle, thereby causing clogging of the nozzle and interfering with casting. Fortunately, even if the casting can be continued, MgO, $NbO_2$ and NbN combined with the base metal fall off from the inner wall of the nozzle and appear as defects on the surface of the Ni-based alloy. For the above reasons, the Nb content is set in the range from 0.001 to 0.100%. Preferably, it is 0.005 to 0.050%, and more preferably, it is 0.010 to 0.040%.

(N: 0.070% or Less)

N is an austenite phase stabilizing element, but when a large amount of N is contained, it forms TiN and causes surface defects. TiN is an inclusion that easily adheres to the inner wall of the immersion nozzle in the continuous casting machine, the deposited deposits fall off from the inner wall and are carried into the mold with the molten metal and captured by the solidified shell, thereby resulting in surface defects in the rolling process. In addition, when the immersion nozzle is clogged with deposits, casting has to be stopped, which imposes a heavy burden on the operation. Therefore, it is set to be 0.070% or less. Preferably, it is 0.050% or less, and more preferably, it is 0.020% or less.

(O: 0.0001 to 0.0050%)

Oxygen concentration is very important in the present invention because it is closely related to inclusions. When O is present in the alloy more than 0.0050%, the number of inclusions increases, thereby leading to surface defects, desulfurization being inhibited, and the S concentration increasing. However, if it is less than 0.0001%, the capacity of Al to reduce CaO and MgO in the slag becomes too high, and the Mg concentration exceeds the upper limit of 0.0200%, and the Ca concentration exceeds the upper limit of 0.0040%. Therefore, the O content is set in the range from 0.0001 to 0.0050%. Preferably, it is 0.0002 to 0.0040%, and more preferably, it is 0.0003 to 0.0025%.

(Oxide-Based Non-Metallic Inclusions)

In the present invention, the composition of oxide-based non-metallic inclusions includes one or more of MgO, CaO, CaO—MgO-based oxides, CaO—$Al_2O_3$—MgO-based oxides, and MgO·$Al_2O_3$, and CaO, and a preferred embodiment is that the total number ratio of CaO—MgO-based oxides is number 50% or less, and the number ratio of MgO·$Al_2O_3$ is number 50% or less. The grounds for limiting the components and number ratios of the oxide-based non-metallic inclusions are shown below.

(The Composition of Oxide-Based Non-Metallic Inclusions Includes One or More of MgO, CaO, CaO—MgO-Based Oxides, CaO—$Al_2O_3$—MgO-Based Oxides, and MgO·$Al_2O_3$)

Ni-based alloy according to the present invention includes one or more of MgO, CaO, CaO—MgO-based oxides, CaO—$Al_2O_3$—MgO-based oxides, and MgO·$Al_2O_3$ according to the contents of Si, Al, Mg, and Ca in the Ni-based alloy. It should be noted that among the above indicating method of the composition of oxide-based non-metallic inclusions, those indicated connected with "-" indicate that the inclusion species are in a solid solution at a temperature of 1600° C. of the refining temperature of the nickel alloy, and those indicated connected with 6. "·" indicating that the inclusion species form an intermediate compound at a temperature of 1600° C. of the refining temperature of the nickel alloy. Regarding CaO—MgO-based oxides, on the CaO—MgO binary system phase diagram, although it is an eutectic composition of CaO and MgO at a temperature of 1600° C., in CaO—MgO-based oxides, since CaO and MgO are finely dispersed in a wide range of the components, it is described with "-" representing a solid solution. Among the oxide-based non-metallic inclusions, the reason MgO and CaO—$Al_2O_3$—MgO-based oxides can be contained without restriction is that the number ratio is that MgO and CaO—$Al_2O_3$—MgO-based oxides do not adhere to the inner wall of the immersion nozzle for pouring molten metal from the tundish of the continuous casting machine into the mold, and therefore, they do not form large deposited deposits and do not cause surface defects.

(Number Ratio of MgO·$Al_2O_3$ is 50% or Less)

MgO·$Al_2O_3$ adheres to the immersion nozzle in the continuous casting machine and becomes large, and the deposited deposit falls off, is carried into the mold together with the molten metal, and is captured by the solidified shell, which can cause surface defects. However, it was found that if the number ratio of MgO·$Al_2O_3$ is 50% or less, the adhesion tendency is mild, and the number of surface defects generated is suppressed. Therefore, the number ratio of MgO·$Al_2O_3$ is set to be 50% or less.

(The Component Ratio of CaO—MgO-Based Oxides is CaO: 20 to 80%, MgO: 20 to 80%)

The concentrations of CaO and MgO in the CaO—MgO-based oxides correspond to the phase ratio of CaO and MgO in the CaO—MgO-based oxides. When the CaO concentration is higher than 80%, the effect of the CaO phase is large and the behavior is similar to that of CaO inclusions, and when the MgO concentration is greater than 80%, the effect of the MgO phase is great and behavior is similar to that of MgO inclusions. Therefore, the CaO concentration of the CaO—MgO-based oxides is set in the range from 20 to 80%, and the MgO concentration is set in the range from 20 to 80%.

(The Component Ratio of CaO—$Al_2O_3$—MgO-Based Oxides is CaO: 10 to 60%, $Al_2O_3$:5 to 60%, MgO: 10 to 80%)

Among the CaO—$Al_2O_3$—MgO-based oxides, if the composition of CaO, $Al_2O_3$, and MgO is within the above range, it is preferable because it maintains a molten state at the temperature in the immersion nozzle. If it is outside this range, it behaves as a solid and tends to adhere to the inner wall of the immersion nozzle in the continuous casting machine, thereby causing surface defects. Furthermore, if the $SiO_2$ content is greater than this range, the number of coarse and large inclusions increases, thereby causing surface defects. Therefore, CaO is set in the range from 10 to 60%, $Al_2O_3$: in the range from 5 to 60%, MgO: in the range from 10 to 80%.

(The Component Ratio of MgO·$Al_2O_3$ is MgO: 10 to 40%, $Al_2O_3$:60 to 90%)

MgO·$Al_2O_3$ is a compound having a relatively wide range of solid solutions, and since it becomes a solid solution within the above range, it is set in this manner.

(The Total Number Ratio of CaO and CaO—MgO-Based Oxides is 50% or Less)

CaO is an inclusion that reacts with moisture in the air on the surface of a product to form a hydrate, thereby falling off from the surface and causing pits. The CaO—MgO-based oxide is an inclusion in which a CaO phase and an MgO phase are mixed in one inclusion. Compared with MgO, CaO—MgO-based oxides tend to be hydrates and fall off from the surface of the product, thereby causing pitting. In addition, CaO and CaO—MgO-based oxides adhere to the inner wall of the immersion nozzle for pouring molten metal from the tundish of the continuous casting machine into the mold, and the enlarged deposits fall off and are carried into the mold together with the molten metal, and they are trapped by the solidified shell and may become a cause of surface defects. On the other hand, it was found that if the total number ratio of CaO and CaO—MgO-based oxides is 50% or less, the tendency of adhesion to nozzles will be low and the number of surface defects will be suppressed, and that the generation of pits due to falling off from the surface of the product as a hydrate was also suppressed. Therefore, the total number ratio of CaO and CaO—MgO-based oxides is set to be 50% or less.

(Production Method)

The present invention also provides a production method for Ni-based alloys. First, a raw material is melted in an electric furnace to melt a Ni-based molten metal having a predetermined composition, then, after decarburization using AOD (Argon Oxygen Decarburization) or AOD followed by VOD (Vacuum Oxygen Decarburization), lime and fluorite are charged, and one or more of ferrosilicon alloy, pure silicon, and Al are charged, and the molten metal is refined using CaO—$SiO_2$—MgO—$Al_2O_3$—F-based slag consisting of CaO: 50 to 75%, $SiO_2$:1 to 10%, $Al_2O_3$:5 to 25%, MgO: 3 to 15%, F: 1 to 15%. Thereafter, the molten metal is poured into a ladle, temperature and composition are adjusted, and slabs or ingots are produced by a continuous casting machine or ordinary ingot casting. The ingot is hot forged to produce a slab. As a result, the oxide-based non-metallic inclusions can be controlled to one or more of MgO, CaO, CaO—MgO-based oxides, CaO—$Al_2O_3$—MgO-based oxides, and MgO·$Al_2O_3$, and the number ratio of the total number of the CaO and the CaO—MgO-based oxides can be 50% or less, and the number ratio of MgO·$Al_2O_3$ can be suppressed to 50% or less, so that a Ni-based alloy with excellent surface properties can be obtained.

The surface of the produced slab is ground, heated, hot rolled to produce a sheet, annealed and pickled, and scales on the surface are removed. In this method, cold rolling is finally applied to produce a thin plate.

The producing method for the Ni-based alloy according to the present invention is characterized by the composition of the slag as described above. The reasons for the slag composition defined in the present invention will be described below.

(CaO: 50 to 75%)

The CaO concentration and $SiO_2$ concentration in the slag are elements for efficiently performing deoxidation and desulfurization and controlling inclusions. If the CaO concentration exceeds 75%, the activity of CaO in the slag increases and the reaction of Formula (2) proceeds too much. As a result, the Ca concentration reduced in the molten metal exceeds 0.0040%, and non-metallic inclusions of CaO alone and/or CaO—MgO-based oxides are generated, and they deposit in the immersion nozzle in the continuous casting machine, the deposits fall off, are carried into the mold with the molten metal, and become trapped in the solidifying shell, thereby resulting in surface defects in the final product. In addition, CaO and CaO—MgO-based oxides react with moisture in the air to form hydrates and are inclusions that fall off from the surface of the final product and cause pits. Therefore, if CaO exists excessively, it causes deterioration of the surface properties. Therefore, the upper limit is set to be 75%. On the other hand, if the CaO concentration is less than 50%, deoxidation and desulfurization do not proceed, making it impossible to control the S concentration and O concentration within the specified range in the present invention. Therefore, the lower limit is set to be 50%. Preferably, it is in the range from 53 to 70%. More preferably, it is in the range from 55 to 68%.

($SiO_2$:1 to 10%)

At least 1% of $SiO_2$ in the slag is necessary since it is an element necessary to ensure optimum fluidity of the slag. However, if it exceeds 10%, the Al concentration, the Mg concentration and the Ca concentration in the molten metal will fall below the specified range, so the upper limit is set to be 10%. Preferably, it is 2 to 8%, and more preferably, it is 3 to 7%.

($Al_2O_3$:5 to 25%)

If the $Al_2O_3$ content in the slag is high, the deoxidation does not proceed sufficiently, the O concentration is not controlled within the specified range, and MgO·$Al_2O_3$ as non-metallic inclusions is formed exceeding 50% in number ratio. In addition, $Al_2O_3$ inclusions that tend to form clusters are also formed. On the other hand, if $Al_2O_3$ in the slag is low, the total number ratio of CaO and CaO—MgO-based oxides among the non-metallic inclusions exceeds 50%. Therefore, the $Al_2O_3$ concentration is set in the range from 5 to 25%. Preferably, it is 6 to 20%, and more preferably, it is 7 to 18%.

(MgO: 3 to 15%)

MgO in the slag is an important element for controlling the Mg concentration contained in the molten metal within the concentration range described in the claims and is also important for controlling non-metallic inclusions to a composition preferred for the present invention. Therefore, the MgO concentration in slag must be 3% or more. On the other hand, if the MgO concentration exceeds 15%, the reaction of Formula (1) proceeds too much, the Mg concentration in the molten metal increases, and the hot workability is deteriorated, thereby resulting in surface defects in the final product. Therefore, the upper limit of the MgO concentration is set to be 15%. The MgO in the slag falls within a predetermined range when the dolomite bricks or the magnesia chromium bricks used in AOD refining or VOD refining dissolve into the slag. Alternatively, one or both of waste bricks such as dolomite bricks and magnesia chromium bricks may be added in order to control the content within a predetermined range. Preferably, it is 4 to 13%, and more preferably, it is 5 to 10%.

(F: 1 to 15%)

Since F has a function for keeping the slag in a molten state when performing slag refining, it is necessary to add at least 1% or more. If the F concentration is less than 1%, the slag will not melt and the fluidity will be low. On the other hand, when the F concentration exceeds 15%, the fluidity of the slag becomes significantly high, and the bricks are significantly eroded. Therefore, it is set in the range from 1 to 15%.

Examples

Next, examples will be presented to further clarify the effects of the present invention. It should be noted that the present invention is not limited only to the following examples. Using an electric furnace with a capacity of 60 tons, ferronickel, pure nickel, ferrochromium, iron scrap, stainless steel scrap, Fe—Ni based alloy scrap, Fe—Mo, and the like, were melted as a raw material. After that, oxygen blowing (oxidation refining) was performed to remove C in AOD or VOD, limestone and fluorite were added, CaO—$SiO_2$—$Al_2O_3$—MgO—F-based slag was formed, and one or both of FeSi alloy and Al was charged to perform Cr reduction and then deoxidation. After that, desulfurization was advanced by further stirring with Ar. AOD and VOD were lined with magnesia chromium bricks. After that, molten metal was poured into a ladle, temperature and composition were adjusted, and a slab was produced by a continuous casting machine.

After the surface of the produced slab was ground, hot rolling was carried out to produce a hot-rolled plate. After that, annealing and pickling were performed to remove surface scales. Finally, cold rolling was performed to produce a cold-rolled sheet with a thickness of 1 mm.

Table 1 shows the chemical composition of the obtained Ni-based alloy and the slag composition at the end of AOD or VOD refining. Invention Example 2 was refined by VOD, Invention Example 5 was refined by VOD following AOD, and the others were refined by AOD. In addition, the slab was made by ordinary ingot casting in Invention Example 3, and by continuous casting in other cases. The numerical values shown in "( )" indicates that it is outside the scope of the claims of the present invention.

TABLE 1

| | | Chemical composition (mass %) balance of inevitable impulities | | | | | | | | | | | | | | |
|---|---|---|---|---|---|---|---|---|---|---|---|---|---|---|---|---|
| | No. | C | Si | Mn | P | S | Ni | Cr | Mo | W | Cu | Co | Al | Ti | Fe | Mg |
| Invention Example | 1 | 0.004 | 0.04 | 0.55 | 0.011 | 0.0002 | 57.0 | 16.2 | 15.7 | 3.14 | 0.10 | 0.47 | 0.030 | 0.005 | 6.68 | 0.0098 |
| | 2 | 0.005 | 0.07 | 0.36 | 0.012 | 0.0001 | 56.3 | 21.4 | 13.0 | 2.62 | 0.06 | 0.26 | 0.075 | 0.004 | 5.75 | 0.0066 |
| | 3 | 0.009 | 0.04 | 0.51 | 0.006 | 0.0004 | 57.2 | 15.7 | 15.8 | 3.33 | 0.07 | 0.25 | 0.025 | 0.008 | 6.98 | 0.0040 |
| | 4 | 0.003 | 0.05 | 0.57 | 0.012 | 0.0004 | 57.8 | 15.2 | 15.7 | 3.48 | 0.08 | 0.10 | 0.067 | 0.004 | 6.80 | 0.0091 |
| | 5 | 0.007 | 0.03 | 0.54 | 0.005 | 0.0006 | 57.7 | 15.8 | 15.5 | 3.19 | 0.16 | 0.37 | 0.070 | 0.006 | 6.55 | 0.0105 |
| | 6 | 0.005 | 0.10 | 0.68 | 0.004 | 0.0033 | 56.1 | 21.3 | 12.9 | 2.66 | 0.05 | 0.25 | 0.112 | 0.009 | 5.74 | 0.0188 |
| | 7 | 0.004 | 0.02 | 0.29 | 0.020 | 0.0015 | 58.1 | 15.2 | 16.0 | 3.22 | 0.19 | 0.20 | 0.004 | 0.004 | 6.67 | 0.0013 |
| | 8 | 0.010 | 0.02 | 1.02 | 0.010 | 0.0010 | 56.8 | 16.5 | 15.6 | 3.21 | 0.10 | 0.22 | 0.008 | 0.004 | 6.44 | 0.0019 |
| | 9 | 0.003 | 0.02 | 0.19 | 0.009 | 0.0007 | 57.9 | 16.0 | 15.5 | 3.20 | 0.06 | 0.29 | 0.054 | 0.088 | 6.58 | 0.0088 |
| | 10 | 0.006 | 0.05 | 0.35 | 0.011 | 0.0002 | 56.9 | 16.5 | 15.8 | 3.12 | 0.11 | 0.33 | 0.120 | 0.005 | 6.66 | 0.0081 |
| | 11 | 0.005 | 0.07 | 0.34 | 0.005 | 0.0005 | 56.4 | 21.2 | 13.2 | 2.59 | 0.06 | 0.22 | 0.071 | 0.003 | 5.75 | 0.0190 |
| | 12 | 0.006 | 0.10 | 0.56 | 0.004 | 0.0003 | 56.4 | 16.6 | 15.9 | 3.13 | 0.15 | 0.19 | 0.163 | 0.005 | 6.67 | 0.0189 |
| | 13 | 0.005 | 0.09 | 0.58 | 0.014 | 0.0004 | 56.9 | 16.3 | 15.6 | 3.23 | 0.09 | 0.33 | 0.083 | 0.005 | 6.69 | 0.0090 |
| Comparative Example | 14 | 0.002 | (0.15) | 0.39 | 0.003 | 0.0005 | 56.4 | 21.1 | 13.1 | 2.51 | 0.07 | 0.28 | 0.076 | 0.005 | 5.77 | 0.0177 |
| | 15 | 0.004 | 0.05 | 0.53 | 0.010 | 0.0004 | 56.2 | 16.7 | 15.6 | 3.22 | 0.08 | 0.31 | (0.188) | 0.006 | 6.87 | (0.0210) |
| | 16 | 0.005 | (0.005) | (0.078) | 0.026 | 0.0031 | 56.6 | 16.6 | 15.8 | 3.59 | 0.13 | 0.18 | (0.00085) | 0.004 | 6.91 | (0.0009) |
| | 17 | 0.004 | 0.01 | 0.60 | 0.010 | 0.0033 | 57.3 | 15.9 | 15.5 | 3.19 | 0.08 | 0.40 | 0.002 | 0.005 | 6.90 | (0.0005) |
| | 18 | 0.006 | 0.07 | 0.34 | 0.013 | 0.0008 | 56.4 | 21.2 | 13.2 | 2.56 | 0.05 | 0.23 | 0.081 | 0.003 | 5.71 | (0.0235) |
| | 19 | 0.005 | 0.07 | 1.07 | 0.019 | 0.0008 | 55.5 | 16.3 | 15.9 | 3.50 | 0.09 | 0.33 | 0.121 | 0.006 | 6.98 | (0.0249) |
| | 20 | 0.008 | 0.08 | 1.18 | 0.015 | 0.0007 | 56.1 | 16.0 | 15.9 | 3.26 | 0.11 | 0.35 | 0.095 | 0.003 | 6.84 | 0.0148 |

| | | Chemical composition (mass %) balance of inevitable impulities | | | | | Slag composition (mass %) | | | | | |
|---|---|---|---|---|---|---|---|---|---|---|---|---|
| | No. | Ca | V | Nb | N | O | CaO | $SiO_2$ | $Al_2O_3$ | MgO | F | C/S |
| Invention Example | 1 | 0.0008 | 0.030 | 0.016 | 0.008 | 0.0020 | 59.5 | 4.8 | 17.5 | 9.5 | 8.7 | 12.4 |
| | 2 | 0.0003 | 0.030 | 0.011 | 0.015 | 0.0005 | 67.4 | 5.4 | 15.1 | 7.8 | 4.3 | 12.5 |
| | 3 | 0.0009 | 0.035 | 0.023 | 0.012 | 0.0015 | 61.6 | 5.2 | 14.7 | 8.1 | 10.4 | 11.8 |
| | 4 | 0.0010 | 0.046 | 0.029 | 0.003 | 0.0009 | 64.4 | 5.5 | 9.8 | 9.6 | 10.7 | 11.7 |
| | 5 | 0.0007 | 0.018 | 0.030 | 0.018 | 0.0003 | 64.0 | 5.4 | 13.8 | 9.3 | 7.5 | 11.9 |
| | 6 | 0.0031 | 0.029 | 0.051 | 0.009 | 0.0001 | 68.2 | 7.7 | 18.5 | 3.1 | 2.5 | 8.9 |
| | 7 | 0.0001 | 0.031 | 0.003 | 0.010 | 0.0042 | 59.3 | 7.9 | 6.6 | 12.9 | 13.3 | 7.5 |
| | 8 | 0.0002 | 0.032 | 0.017 | 0.005 | 0.0029 | 65.1 | 9.5 | 5.8 | 8.2 | 11.4 | 6.9 |
| | 9 | 0.0002 | 0.023 | 0.009 | 0.054 | 0.0033 | 63.0 | 4.6 | 16.4 | 8.6 | 7.4 | 13.7 |
| | 10 | 0.0009 | 0.028 | 0.018 | 0.010 | 0.0007 | 58.6 | 6.6 | 20.2 | 7.5 | 7.1 | 8.9 |

TABLE 1-continued

| | | | | | | | | | | | | |
|---|---|---|---|---|---|---|---|---|---|---|---|---|
| | 11 | 0.0007 | 0.031 | 0.013 | 0.007 | 0.0017 | 61.9 | 5.2 | 12.3 | 9.9 | 10.7 | 11.9 |
| | 12 | 0.0032 | 0.044 | 0.041 | 0.007 | 0.0002 | 62.2 | 4.4 | 18.2 | 5.6 | 9.6 | 14.1 |
| | 13 | 0.0039 | 0.034 | 0.030 | 0.005 | 0.0002 | 72.5 | 2.0 | 12.2 | 7.0 | 6.3 | 36.3 |
| Comparative Example | 14 | (0.0066) | 0.033 | 0.055 | 0.006 | 0.0001 | 62.3 | 5.0 | 20.8 | 9.8 | 2.1 | 12.5 |
| | 15 | (0.0051) | 0.040 | (0.116) | 0.012 | (0.00007) | 68.5 | 3.0 | 10.9 | 7.7 | 9.9 | 22.8 |
| | 16 | (0.00008) | 0.043 | (0.0008) | 0.008 | (0.0062) | 59.2 | 5.3 | 15.7 | 8.2 | 11.6 | 11.2 |
| | 17 | (0.00006) | 0.031 | 0.004 | 0.008 | 0.0045 | 55.2 | 2.5 | (28.3) | 7.9 | 6.1 | 22.1 |
| | 18 | 0.0005 | 0.029 | 0.044 | 0.012 | 0.0002 | 56.6 | 3.8 | 7.6 | (18.1) | 13.9 | 14.9 |
| | 19 | 0.0027 | 0.036 | 0.019 | 0.013 | 0.0016 | 63.8 | 4.5 | 15.0 | 9.5 | 7.2 | 14.2 |
| | 20 | (0.0075) | 0.032 | 0.022 | 0.012 | 0.0002 | (76.3) | (0.9) | 10.1 | 6.4 | 6.3 | 84.8 |

TABLE 2

| | | Oxide-based non-metallic inclusion composition (mass %) measured by EDS at 20 points | | | | | | | | | | | | | | |
|---|---|---|---|---|---|---|---|---|---|---|---|---|---|---|---|---|
| | | MgO | | MgO•$Al_2O_3$-base | | | CaO—$Al_2O_3$—MgO-base | | | | | CaO—MgO-base | | | CaO | |
| | No. | n | MgO | n | MgO | $Al_2O_3$ | n | CaO | $Al_2O_3$ | MgO | $SiO_2$ | n | CaO | MgO | n | CaO |
| Invention Example | 1 | 18 | 100 | | | | | | | | | 2 | 44.2 | 55.8 | | |
| | 2 | 20 | 100 | | | | | | | | | | | | | |
| | 3 | 11 | 100 | 1 | 37.5 | 62.5 | 8 | 49.8 | 12.4 | 35.4 | 2.4 | | | | | |
| | 4 | 7 | 100 | | | | 9 | 53.2 | 20.9 | 24.7 | 1.2 | 4 | 52.8 | 47.2 | | |
| | 5 | 20 | 100 | | | | | | | | | | | | | |
| | 6 | 11 | 100 | | | | | | | | | 6 | 69.9 | 30.1 | 3 | 100 |
| | 7 | | | 9 | 35.3 | 64.7 | 11 | 25.0 | 20.4 | 49.8 | 4.8 | | | | | |
| | 8 | | | | | | 20 | 38.8 | 15.5 | 21.8 | 23.9 | | | | | |
| | 9 | 3 | 100 | 7 | 25.9 | 74.1 | 10 | 9.3 | 61.5 | 27.0 | 2.2 | | | | | |
| | 10 | | | 6 | 9.5 | 90.5 | 14 | 30.5 | 44.2 | 22.3 | 3.0 | | | | | |
| | 11 | 17 | 100 | 3 | 41.3 | 58.7 | | | | | | | | | | |
| | 12 | 9 | 100 | | | | | | | | | 11 | 19.1 | 80.9 | | |
| | 13 | | | | | | 7 | 61.8 | 20.5 | 14.2 | 3.5 | 3 | 81.1 | 18.9 | 10 | 100 |
| Comparative Example | 14 | 2 | 100 | | | | | | | | | 6 | 71.9 | 28.1 | 12 | 100 |
| | 15 | 15 | 100 | | | | 2 | 39.0 | 31.9 | 27.6 | 1.5 | 3 | 21.6 | 78.4 | | |
| | 16 | | | | | | 17 | 37.7 | 26.5 | 26.1 | 9.7 | 2 | 46.3 | 53.7 | 1 | 100 |
| | 17 | | | 12 | 35.5 | 64.5 | 2 | 8.6 | 79.9 | 8.8 | 2.7 | | | | | |
| | 18 | 12 | 100 | | | | | | | | | 8 | 22.4 | 77.6 | | |
| | 19 | 2 | 100 | 18 | 29.9 | 70.1 | | | | | | | | | | |
| | 20 | | | | | | | | | | | 1 | 95.2 | 4.8 | 19 | 100 |

| | | Oxide-based non-metallic inclusion composition (mass %) measured by EDS at 20 points | | | | | | | |
|---|---|---|---|---|---|---|---|---|---|
| | | $Al_2O_3$ | | | | | | | |
| | No. | n | $Al_2O_3$ | Number ratio of MgO•$Al_2O_3$-base % | Number ratio of CaO + CaO—MgO-base % | Inclusions other than those on the left | Surface defect evaluation | Pit evaluation | Total evaluation |
| Invention Example | 1 | | | 0 | 10 | — | A | A | A |
| | 2 | | | 0 | 0 | — | A | A | A |
| | 3 | | | 5 | 0 | — | B | A | A |
| | 4 | | | 0 | 20 | — | A | B | A |
| | 5 | | | 0 | 0 | — | A | A | A |
| | 6 | | | 0 | 45 | — | B | C | C |
| | 7 | | | 45 | 0 | — | C | A | B |
| | 8 | | | 0 | 0 | — | B | A | B |
| | 9 | | | 35 | 0 | TiN | C | A | B |
| | 10 | | | 30 | 0 | — | C | A | B |
| | 11 | | | 15 | 0 | — | B | A | B |
| | 12 | | | 0 | 55 | — | B | C | C |
| | 13 | | | 0 | 65 | — | B | C | C |
| Comparative Example | 14 | | | 0 | 90 | — | D | D | D |
| | 15 | | | 0 | 15 | $NbO_2$, NbN | D | B | D |
| | 16 | | | 0 | 15 | — | D | C | D |
| | 17 | 6 | 100 | (60) | 0 | — | D | A | D |
| | 18 | | | 0 | 40 | — | D | B | D |
| | 19 | | | (90) | 0 | — | D | B | D |
| | 20 | | | 0 | 100 | — | D | D | D |

(1) Alloy chemical composition and slag composition: Quantitative analysis was performed using a fluorescent X-ray analyzer, and the oxygen concentration of the alloy was quantitatively analyzed by inert gas impulse melting infrared absorption method.

(2) Composition of non-metallic inclusions: Immediately after the start of casting, a sample was taken in a tundish and was mirror-polished, and using SEM-EDS, inclusions with a size of 5 μm or more were randomly measured at 20 points.

(3) Number ratio of inclusions: From the results of the measurement in (2) above, the total number ratio of CaO and CaO—MgO-based oxides and the number ratio of $MgO \cdot Al_2O_3$ with respect to the total number of non-metallic inclusions were evaluated.

(4) Evaluation of surface defects: The surface of the cold-rolled sheet having a thickness of 1 mm produced by rolling was visually observed over the entire length, and the number of non-metallic inclusions and surface defects caused by hot workability, that were found in a width of 1 m and a length of 100 m, was counted. In the quality evaluation, A was given when the number of surface defects was 2 or less, B was given when it was 3 to 5, C was given when it was 6 to 10, and D was given when it was 11 or more.

(5) Pit evaluation: A test piece was taken from the thin plate with a thickness of 1 mm in (4) above, mirror-finished, held in an atmosphere with a humidity of 60% and a temperature of 40° C. for 24 hours, and then the surface of this test piece was washed with water. After buffing to a depth of 1 μm, the number of pits exceeding 10 μm in depth and 40 μm in diameter was measured on the surface of a 10 cm×10 cm test piece using a 3D laser microscope. If the number of pits was 0, it was evaluated as A, if it was 1 to 2, it was evaluated as B, if it was 3 to 5, it was evaluated as C, and if it was 6 or more, it was evaluated as D.

(6) Total evaluation: The results of surface defect evaluation and pit evaluation were scored as follows.

Pit evaluation: A 3 points, B 2 points, C 1 point, D 0 points

Surface defect evaluation: A 3 points, B 2 points, C 1 point, D 0 points

After that, as a total evaluation, if the total score of pit evaluation and surface defect was 6 points, it was evaluated as A, if it was 4 to 5 points, it was evaluated as B, if it was 3 points, it was evaluated as C, if it was 2 points or fewer or surface defect evaluation or pit evaluation was D, it was evaluated as D.

Since Invention Examples 1 to 11 satisfied the range of the present invention, the surface of the cold-rolled sheet had few surface defects and almost no coarse pits exceeding 10 μm in depth and 40 μm in diameter, thereby indicating good surface properties.

In Invention Example 6, the Si concentration was 0.10 mass % and the Al concentration was 0.112 mass %, which were both within the predetermined ranges but were high. As a result of the slightly stronger deoxidation, the supply of Mg and Ca from the slag was slightly increased, and the total number ratio of CaO and CaO—MgO-based oxides was slightly increased. As a result, a few pits exceeding 10 μm in depth and 40 μm in diameter were observed on the surface of the 10 cm×10 cm test piece.

In Invention Example 7, the Si concentration was 0.02 mass % and the Al concentration was 0.004 mass %, all of which were both within the predetermined ranges, but were low. As a result of the slightly weaker deoxidation, the supply of Mg and Ca from the slag was slightly insufficient, and the number ratio of $MgO \cdot Al_2O_3$ was slightly increased. As a result, the large-sized $MgO \cdot Al_2O_3$ adhering to the inner wall of the immersion nozzle was caught in the alloy, and surface defects were slightly generated.

In Invention Example 8, the $SiO_2$ concentration in the slag was slightly high at 9.5 mass %, thereby resulting in the Si concentration of 0.02 mass %, the Mg concentration of 0.0019 mass %, and the Ca concentration of 0.0002 mass %, all of which were both within the predetermined range, but were low. $SiO_2$ in the CaO—$Al_2O_3$—MgO-based oxides increased to 23.9 mass %, and inclusions tended to increase in size, thereby resulting in slight generation of surface defects.

In Invention Example 9, the Si concentration is 0.02 mass % and the Mn concentration is 0.19 mass %, which are both within the specified ranges, but are slightly low, deoxidation is slightly insufficient, and the amount of Ca supplied from the slag was slightly insufficient. As a result, CaO in the CaO—$Al_2O_3$—MgO-based oxides was as low at 9.3 mass %, $Al_2O_3$ was high at 61.5 mass %, and $MgO \cdot Al_2O_3$ was formed. As a result, the inclusions adhered to the inner wall of the immersion nozzle in the continuous casting machine, and the inclusions tended to increase in size, thereby resulting in the slight generation of surface defects. Ti concentration exceeded the predetermined range, surface defects due to TiN inclusions were slightly generated.

In Invention Example 10, when Al was added just before the end of refining, the $Al_2O_3$ concentration in the slag increased to be slightly high at 20.2 mass %, and the Al concentration also increased to be slightly high at 0.120 mass %. As a result, the $Al_2O_3$ concentration in $MgO \cdot Al_2O_3$ increased to 90.5 mass %, and the properties became like $Al_2O_3$ alone, and clusters were likely to be generated. However, since the number ratio of the generated $MgO \cdot Al_2O_3$ was number 50% or less, only a few surface defects were generated.

In Invention Example 11, when Mg was directly added for component adjustment, the Mg concentration was slightly high at 0.0190 mass %. As a result, the MgO concentration in $MgO \cdot Al_2O_3$ increased to 41.3 mass %, and the melting point of $MgO \cdot Al_2O_3$ decreased, thereby making clusters more likely to be generated. However, since the number ratio of the generated $MgO \cdot Al_2O_3$ was number 50% or less, only a few surface defects were generated.

In Invention Example 12, the Al concentration was 0.163 mass %, which was within the specified range, but was slightly high, and the deoxidation reaction proceeded excessively. As a result, Mg and Ca were excessively supplied from the slag to the molten metal, and the Mg concentration and the Ca concentration increased. As a result, CaO—MgO-based oxides were generated with a number ratio slightly exceeding number 50%, and pits with a depth of more than 10 μm and a diameter exceeding more than 40 μm were slightly observed on the surface of the 10 cm×10 cm test piece.

In Invention Example 13, the amount of lime input during refining was slightly large, so the CaO concentration in the slag was slightly high at 72.5 mass %. As a result, the CaO activity in the slag increased, Ca was excessively supplied to the molten metal, and the Ca concentration slightly increased to 0.0039 mass %. As a result, CaO inclusions were generated, CaO and CaO—MgO-based oxides were generated with a total number ratio of exceeding 50%, and pits exceeding 10 pum in depth and 40 μm in diameter slightly generated on the surface of the 10 cm×10 cm test piece were observed.

On the other hand, since the comparative examples were out of the range of the present invention, many surface defects and/or pits were generated and the surface properties were deteriorated. Each example will be described below.

In Comparative Example 14, the Si concentration was as high at 0.15 mass %, exceeding the predetermined range, and the deoxidation reaction excessively proceeded. As a result, Mg and Ca were excessively supplied from the slag to the molten metal, specifically, the Ca concentration increased to 0.0066 mass %, which is higher than the predetermined range. As a result, many non-metallic inclusions of CaO and CaO—MgO-based oxides were generated, and many pits exceeding 10 pun in depth and 40 μm in diameter were observed on the surface of the 10 cm×10 cm test piece, and the surface properties deteriorated.

In Comparative Example 15, the Al concentration was high at 0.188 mass %, the deoxidation reaction excessively proceeded, and the O concentration was lower than the specified range of 0.00007 mass %. As a result, Mg and Ca were excessively supplied from the slag to the molten metal, and the Mg concentration and Ca concentration increased beyond the predetermined range.

In addition, since the O concentration was lower than the expected range, Nb was hardly oxidized and the remained in the molten metal, and the Nb concentration was 0.116 mass %, which exceeded the specified range. As a result, $NbO_2$ and NbN were formed in the molten metal, thereby forming clusters of MgO inclusions and composite of oxynitrides, which clogged the inner wall of the submerged nozzle in the continuous casting machine together with the base metal, and the larger ones fell off and were trapped in the alloy. As a result, many surface defects were generated and the surface properties were deteriorated.

In Comparative Example 16, since the Si concentration was 0.005 mass %, the Mn concentration was 0.078 mass %, and the Al concentration was 0.00085 mass %, that were lower than the predetermined ranges, the O concentration was high at 0.0062%, and the Nb was oxidized and not yielded at the concentration of 0.0085 mass %. As a result, although the CaO—$Al_2O_3$—MgO-based oxide was the main component, the high O concentration increased the number of non-metallic inclusions, thereby resulting in a large number of surface defects caused by the inclusions and resulting in deteriorated surface properties.

In Comparative Example 17, the added Al came into direct contact with the slag, did not remain in the molten metal, but became an oxide, and the $Al_2O_3$ concentration in the slag increased to 28.3 mass %. Furthermore, insufficient deoxidation due to lack of Al in the molten metal resulted in insufficient supply of Mg and Ca from the slag, thereby resulting in lower Mg and Ca concentrations than predetermined concentrations. For this reason, $MgO{\cdot}Al_2O_3$ was formed in a number ratio of more than number 50% and clustered, and non-metallic inclusions of $Al_2O_3$ alone were also formed and clustered, thereby resulting in a large number of defects on the surface of the final product, and the surface properties were deteriorated.

In Comparative Example 18, the refractory material was severely eroded, so the MgO concentration in the slag was 18.1 mass %, which exceeded the predetermined range, and excessive Mg was supplied to the molten metal, thereby resulting in the Mg concentration of 0.0235 mass %, which exceeded the predetermined limits. As a result, the hot workability was remarkably deteriorated, and many surface defects due to the hot workability generated in the final product, resulting in deterioration of the surface properties.

In Comparative Example 19, when Mg was added just before the end of refining to adjust the composition, it reacted with $Al_2O_3$ in the slag, thereby generating many $MgO{\cdot}Al_2O_3$ inclusions. As a result, $MgO{\cdot}Al_2O_3$ inclusions adhered and deposited on the immersion nozzle in the continuous casting machine, and larger ones fell off and were captured by the solidified shell, thereby resulting in many surface defects. In addition, because of the Mg concentration of 0.0249 mass % which exceeded the predetermined range, the hot workability was significantly deteriorated, and many surface defects due to hot workability were generated in the final product, thereby resulting in deteriorated surface properties.

In Comparative Example 20, excess lime was added, the CaO concentration in the slag was 76.3 mass %, which was higher than the predetermined range, and the $SiO_2$ concentration was 0.9 mass %, which was lower than the predetermined range. As a result, the CaO activity in the slag increased, Ca was excessively supplied to the molten metal, and the Ca concentration increased to 0.0075 mass %.

As a result, a large number of CaO inclusions were formed, and the CaO in the CaO—MgO-based oxide increased beyond the predetermined range, thereby resulting in surface defects caused by the inclusions, and a large number of pits exceeding 10 μm in depth and 40 μm in diameter were observed on the surface of the test piece, and the surface properties were deteriorated.

INDUSTRIAL APPLICABILITY

By controlling the form of non-metallic inclusions, the technique of the present invention can provide Ni-based alloys with superior surface properties suitable for use in flue gas desulfurizers, which are severely corrosive environments.

The invention claimed is:

1. A Ni-based alloy consisting of, all by mass %: Ni: 52.0% or more, C: 0.001% to 0.030%, Si: 0.01 to 0.10%, Mn: 0.10 to 1.50%, P: 0.030% or less, S: 0.0050% or less, Cr: 13.0 to 25.0%, Mo: 10.0 to 18.0%, W: 1.00 to 5.00%, Cu: 1.00% or less, Co: 3.00% or less, Al: 0.001 to 0.170%, Fe: 2.00 to 8.00%, Mg: 0.0010 to 0.0200%, Ca: 0.0001 to 0.0040%, V: 0.500% or less, Nb: 0.001 to 0.100%, O: 0.0001 to 0.0050%, optionally 0.070% or less of Ti, optionally 0.070% or less of N, and balance of inevitable impurities; the alloy also including non-metallic inclusions, wherein the non-metallic inclusions comprise one or more of MgO, CaO, CaO—MgO-based oxides, CaO—$Al_2O_3$—MgO-based oxides, and $MgO{\cdot}Al_2O_3$, and the $MgO{\cdot}Al_2O_3$ has a number ratio of 50% or less with respect to all oxide-based non-metallic inclusions.

2. A production method of the Ni-based alloy according to claim 1, comprising melting a raw material in an electric furnace, then decarburizing in AOD (argon oxygen decarburization) and/or VOD (vacuum oxygen decarburization), charging lime and fluorite, then charging one or more of ferrosilicon alloy, pure silicon and Al, Cr reducing, deoxidizing and desulfurizing using CaO—$SiO_2$—MgO—$Al_2O_3$—F-based slag consisting of CaO: 50 to 75%, $SiO_2$: 1 to 10%, $Al_2O_3$: 5 to 25 mass %, MgO: 3 to 15%, and F: 1 to 15%, producing a slab or ingot by a continuous casting machine or ordinary ingot casting, hot forging the ingot, hot rolling and cold rolling, thereby obtaining a Ni-based alloy or Ni-based alloy plate.

3. The Ni-based alloy according to claim 1, wherein in the non-metallic inclusions, the number ratio of the total number of the CaO and the CaO—MgO-based oxides is 50% or less.

4. The Ni-based alloy according to claim 3, wherein in the non-metallic inclusions, all by mass %, CaO—MgO-based oxides consists of CaO: 20 to 80% and MgO: 20 to 80%, CaO—$Al_2O_3$—MgO-based oxides consists of CaO: 10 to 60%, $Al_2O_3$: 5 to 60%, and MgO: 10 to 80%, and MgO·$Al_2O_3$ consists of MgO: 10 to 40% and $Al_2O_3$:60 to 90%.

5. A production method of the Ni-based alloy according to claim 3, comprising melting a raw material in an electric furnace, then decarburizing in AOD and/or VOD, charging lime and fluorite, then charging one or more of ferrosilicon alloy, pure silicon and Al, Cr reducing, deoxidizing and desulfurizing using CaO—$SiO_2$—MgO—$Al_2O_3$—F-based slag consisting of CaO: 50 to 75%, $SiO_2$:1 to 10%, $Al_2O_3$:5 to 25 mass %, MgO: 3 to 15%, and F: 1 to 15%, producing a slab or ingot by a continuous casting machine or ordinary ingot casting, hot forging the ingot, hot rolling and cold rolling, thereby obtaining a Ni-based alloy or Ni-based alloy plate.

6. The Ni-based alloy according to claim 1, wherein in the non-metallic inclusions, all by mass %, CaO—MgO-based oxides consists of CaO: 20 to 80% and MgO: 20 to 80%, CaO—$Al_2O_3$—MgO-based oxides consists of CaO: 10 to 60%, $Al_2O_3$: 5 to 60%, MgO: 10 to 80%, and $SiO_2$: 10% or less, and MgO·$Al_2O_3$ consists of MgO: 10 to 40% and $Al_2O_3$:60 to 90%.

7. A production method of the Ni-based alloy according to claim 6, comprising melting a raw material in an electric furnace, then decarburizing in AOD and/or VOD, charging lime and fluorite, then charging one or more of ferrosilicon alloy, pure silicon and Al, Cr reducing, deoxidizing and desulfurizing using CaO—$SiO_2$—MgO—$Al_2O_3$—F-based slag consisting of CaO: 50 to 75%, $SiO_2$: 1 to 10%, $Al_2O_3$: 5 to 25 mass %, MgO: 3 to 15%, and F: 1 to 15%, producing a slab or ingot by a continuous casting machine or ordinary ingot casting, hot forging the ingot, hot rolling and cold rolling, thereby obtaining a Ni-based alloy or Ni-based alloy plate.

8. A Ni-based alloy comprising, all by mass %: Ni: 52.0% or more, C: 0.001% to 0.030%, Si: 0.01 to 0.10%, Mn: 0.10 to 1.50%, P: 0.030% or less, S: 0.0050% or less, Cr: 13.0 to 25.0%, Mo: 10.0 to 18.0%, W: 1.00 to 5.00%, Cu: 1.00% or less, Co: 3.00% or less, Al: 0.001 to 0.170%, Fe: 2.00 to 8.00%, Mg: 0.0010 to 0.0200%, Ca: 0.0001 to 0.0040%, V: 0.500% or less, Nb: 0.001 to 0.100%, O: 0.0001 to 0.0050%, balance of inevitable impurities; the alloy also including non-metallic inclusions, wherein the non-metallic inclusions comprise one or more of MgO, CaO, CaO—MgO-based oxides, CaO—$Al_2O_3$—MgO-based oxides, and MgO·$Al_2O_3$, and the MgO·$Al_2O_3$ has a number ratio of 50% or less with respect to all oxide-based non-metallic inclusions.

9. The Ni-based alloy according to claim 8, wherein the alloy further comprises 0.070% or less of Ti and 0.070% or less of N.

10. The Ni-based alloy according to claim 8, wherein in the non-metallic inclusions, the number ratio of the total number of the CaO and the CaO—MgO-based oxides is 50% or less.

11. The Ni-based alloy according to claim 8, wherein in the non-metallic inclusions, all by mass %, CaO—MgO-based oxides consists of CaO: 20 to 80% and MgO: 20 to 80%, CaO—$Al_2O_3$—MgO-based oxides consists of CaO: 10 to 60%, $Al_2O_3$: 5 to 60%, MgO: 10 to 80%, and $SiO_2$: 10% or less, and MgO·$Al_2O_3$ consists of MgO: 10 to 40% and $Al_2O_3$:60 to 90%.

12. A production method of the Ni-based alloy according to claim 8, comprising melting a raw material in an electric furnace, then decarburizing in AOD and/or VOD, charging lime and fluorite, then charging one or more of ferrosilicon alloy, pure silicon and Al, Cr reducing, deoxidizing and desulfurizing using CaO—$SiO_2$—MgO—$Al_2O_3$—F-based slag comprising CaO: 50 to 75%, $SiO_2$: 1 to 10%, $Al_2O_3$: 5 to 25 mass %, MgO: 3 to 15%, and F: 1 to 15%, producing a slab or ingot by a continuous casting machine or ordinary ingot casting, hot forging the ingot, hot rolling and cold rolling, thereby obtaining a Ni-based alloy or Ni-based alloy plate.

* * * * *